US012509188B2

(12) United States Patent
Cittadine et al.

(10) Patent No.: US 12,509,188 B2
(45) Date of Patent: Dec. 30, 2025

(54) RETRACTABLE COVER

(71) Applicants: Jack P. Cittadine, Elkhart, IN (US); Prabodh Ajit Sonalkar, South Bend, IN (US)

(72) Inventors: Jack P. Cittadine, Elkhart, IN (US); Prabodh Ajit Sonalkar, South Bend, IN (US)

(73) Assignee: Jack P. Cittadine, Elkhart, IN (US)

( * ) Notice: Subject to any disclaimer, the term of this patent is extended or adjusted under 35 U.S.C. 154(b) by 392 days.

(21) Appl. No.: 18/239,879

(22) Filed: Aug. 30, 2023

(65) Prior Publication Data

US 2024/0076012 A1 Mar. 7, 2024

Related U.S. Application Data

(60) Provisional application No. 63/403,139, filed on Sep. 1, 2022.

(51) Int. Cl.
*B63B 17/02* (2006.01)

(52) U.S. Cl.
CPC ..... *B63B 17/02* (2013.01)

(58) Field of Classification Search
CPC ..... B63B 17/02
See application file for complete search history.

(56) References Cited

U.S. PATENT DOCUMENTS

| | | | | |
|---|---|---|---|---|
| 7,370,597 | B1 | 5/2008 | Schwindaman | |
| 7,389,737 | B1 | 6/2008 | Schwindaman | |
| 7,438,015 | B1 | 10/2008 | Schwindaman | |
| 7,520,240 | B2 | 4/2009 | Tufte | |
| 7,784,420 | B2 | 8/2010 | Tufte | |
| 7,950,342 | B2 | 5/2011 | Russikoff | |
| 8,056,497 | B1 | 11/2011 | Rondeau et al. | |
| 8,359,994 | B1 | 1/2013 | Highfield | |
| 8,752,498 | B1 | 6/2014 | Schwindaman et al. | |
| 9,783,267 | B1 * | 10/2017 | Alexander | B63B 17/02 |
| 10,173,754 | B2 | 1/2019 | Parniske et al. | |
| 2006/0162641 | A1 * | 7/2006 | Tufte | B63B 17/02 114/361 |
| 2008/0244820 | A1 * | 10/2008 | Moore | E04H 4/108 4/498 |
| 2010/0083891 | A1 * | 4/2010 | Russikoff | B63B 17/02 114/361 |

FOREIGN PATENT DOCUMENTS

| | | | |
|---|---|---|---|
| EP | 0827856 | B1 | 5/2001 |

* cited by examiner

*Primary Examiner* — Evan P Dzierzynski
(74) *Attorney, Agent, or Firm* — Sanders Pianowski LLP

(57) ABSTRACT

A watercraft cover has a frame that includes independently moveable front and rear frame sections. Together, the front and rear frame sections are moveable between a covered position, Bimini position, radar position, and stowed position. In the Bimini and covered positions, the front frame section is coupled to link members to allow the front frame to telescope outwardly as it moves from the Bimini position to the covered position. The front and rear frame sections each have a telescoping x-shaped scissor linkage that connects to a respective intermediate support. The Fabric or cover material is attached to the frame sections.

20 Claims, 11 Drawing Sheets

RETRACTABLE COVER

CROSS REFERENCE TO RELATED APPLICATIONS

This application claims the benefit of Provisional Application Ser. No. 63/403,139 filed Sep. 1, 2022, the disclosure of which is incorporated by reference.

BACKGROUND OF THE INVENTION

The present disclosure relates to boat covers, shades, Bimini tops, and other covers for shading and/or protecting a boat. Boat shades and/or Bimini tops are a desirable option on a watercraft to shade the driver and passengers. Many shades have the option to be moved to a few positions, such as a storage position, radar position, and one or two shade positions. The storage position is where the cover is out of the way for when the boat is covered or when the boat passes into a low clearance area. The radar position is where the cover is up but not deployed where it provides shade. The Bimini/shade position(s) is/are where the fabric is providing some shade to at least part of the boat. For boat storage, the shade is not enough protection from the elements and typically must be moved to the storage position so the user can install a separate cover over the entire boat. Keeping two separate covers for different uses requires the boat cover to be stored unless the boat is completely covered, resulting in inconvenience to the user and the possibility of the cover being damaged or lost when not in use. An improved system where one cover works for any situation is needed.

SUMMARY OF THE INVENTION

The present disclosure describes a convertible boat cover that performs the functions of a shade and a full boat cover. This eliminates the need for a separate shade and/or protective cover. The mechanism has a front section and a rear section that are movable between raised and lowered positions. A fabric cover material extends between the front section and rear section. The front and rear sections each have their own intermediate supports that are deployed as the cover expands. When the front and rear sections are in the lowered positions, the fabric covers the deck of the boat with intermediate bows and expanding scissor assemblies to support the fabric.

DESCRIPTION OF THE PREFERRED EMBODIMENT

Figure 1:
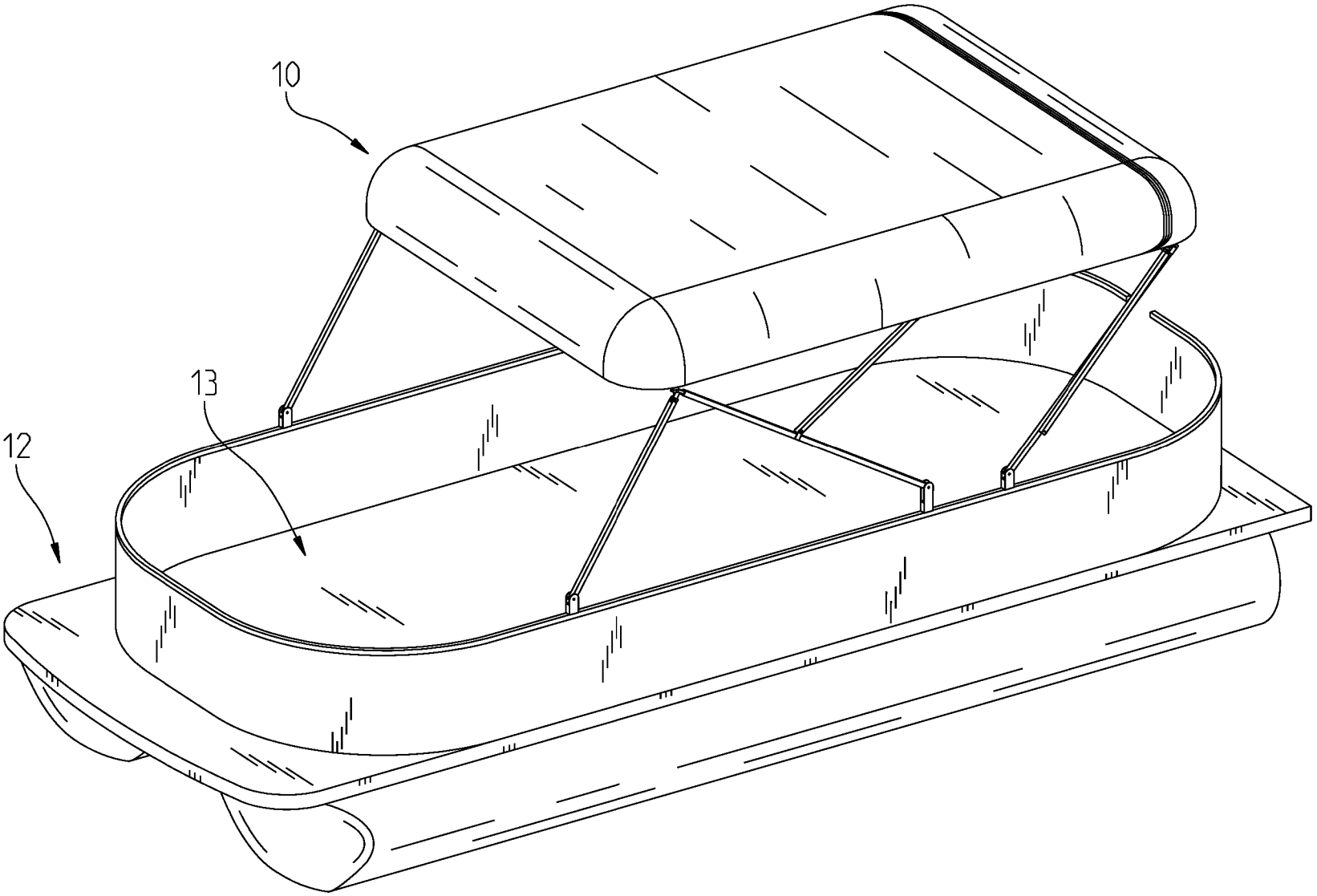
FIG. 1 is an isometric view of a retractable cover attached to a watercraft.
Figure 4:
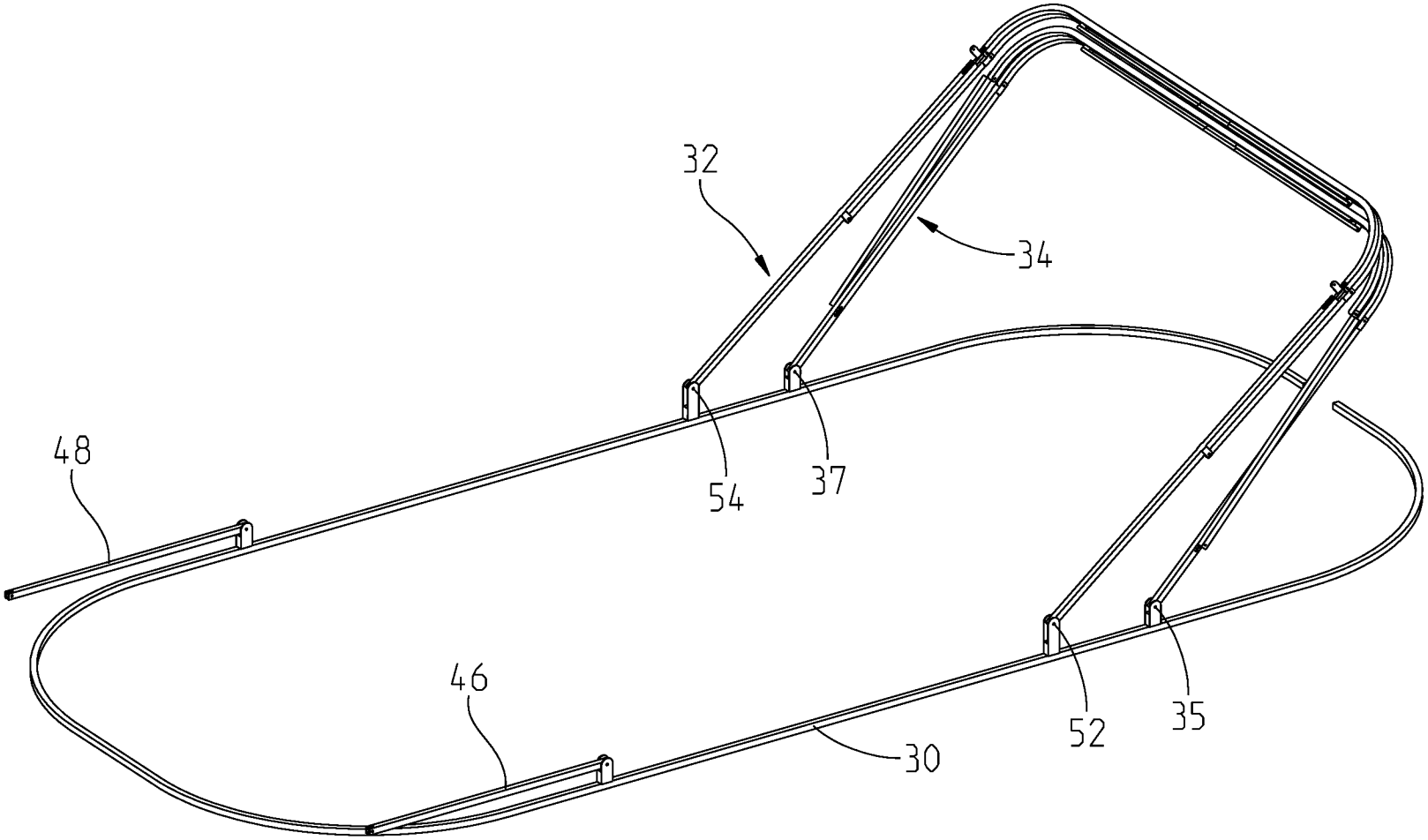
FIG. 4 is a side isometric view of the frame in FIG. 3 in the radar position.
Figure 5:
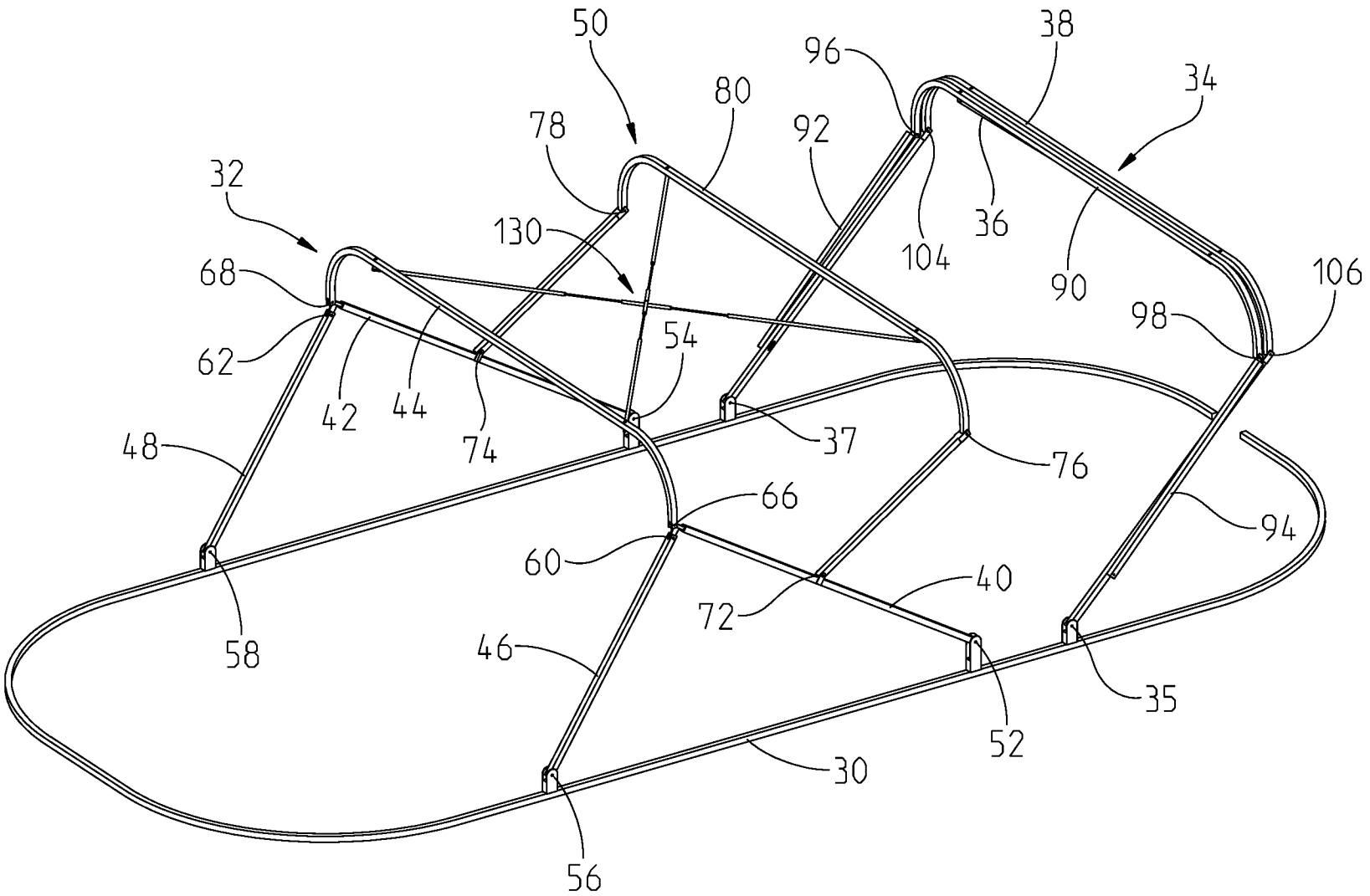
FIG. 5 is a side isometric view of the frame in FIG. 3 in the Bimini position.
Figure 6:
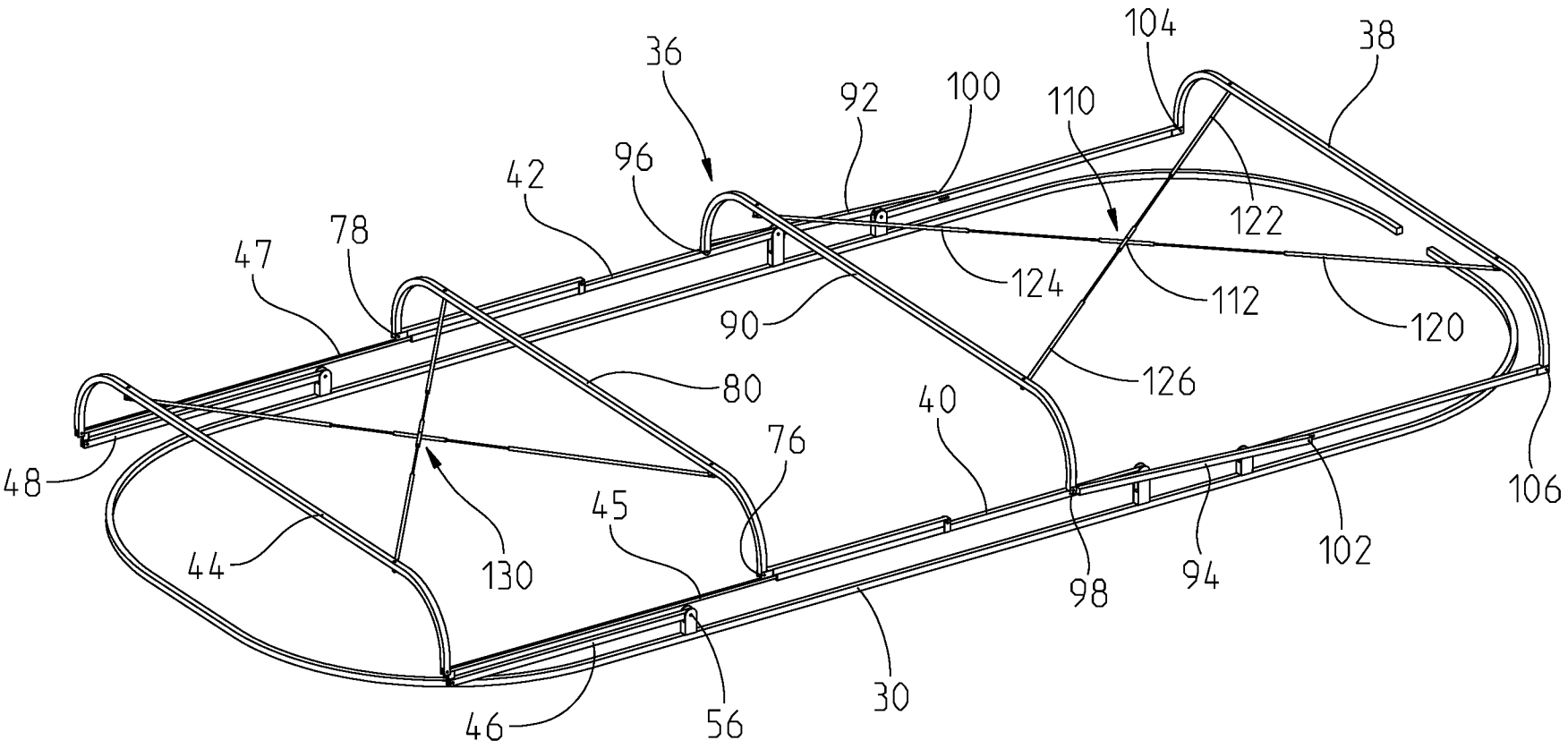
FIG. 6 is a side isometric view of the frame in FIG. 3 in the covered position.
Figure 7:
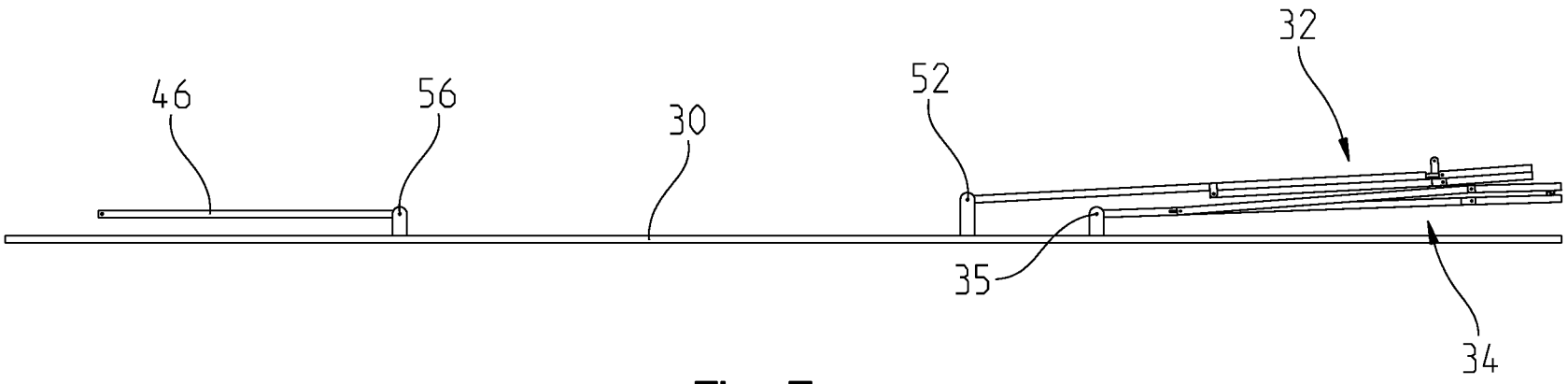
FIG. 7 is a side view of the cover in the stowed position.
Figure 8:
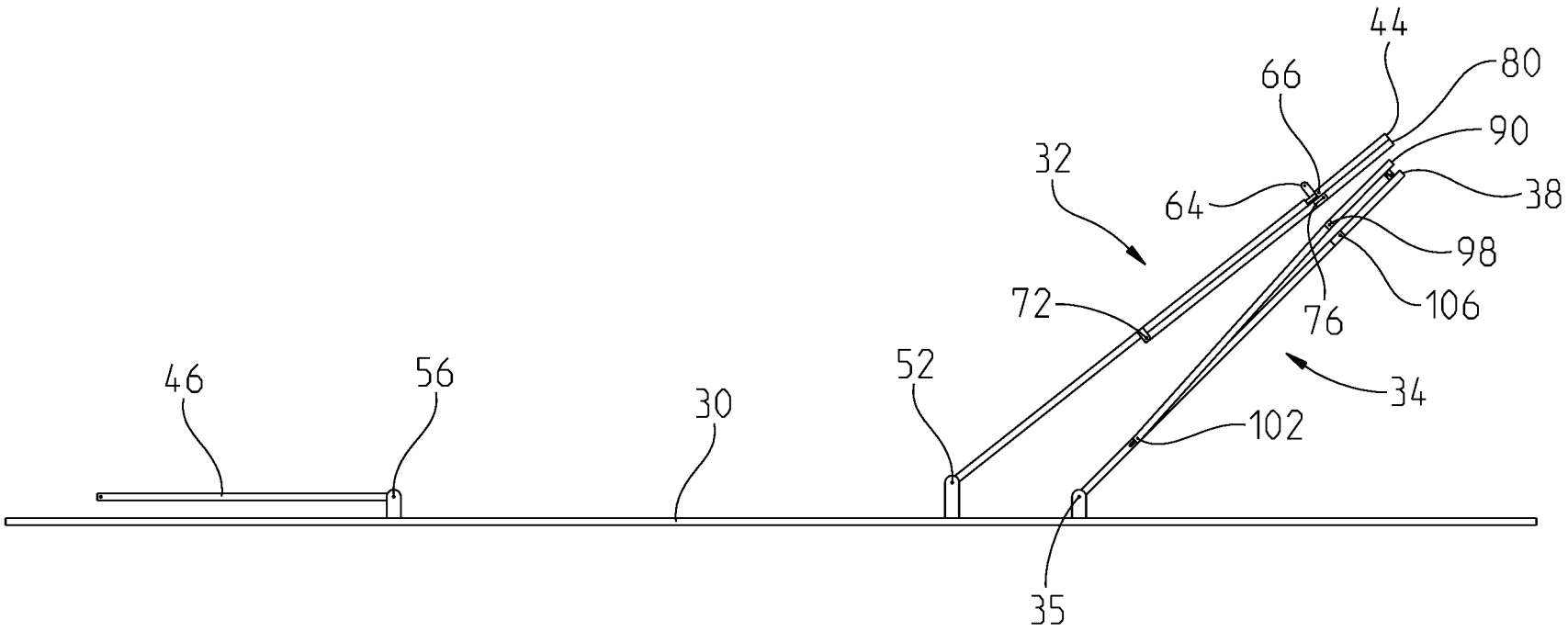
FIG. 8 is a side view of the cover in the radar position.

A retractable cover 10 is shown in FIG. 1 attached to a watercraft 12 with a deck 13. As is shown in FIGS. 1-10, the cover 10 can be positioned in at least four main positions, stowed (FIG. 3), radar (FIG. 4), Bimini (FIG. 5), and covered (FIG. 6). The cover 10 has a frame mechanism 20 and cover fabric 22 that is supported by the frame mechanism 20. The cover fabric 22 is shown as transparent in FIGS. 1-2 to show the detail of the fore and aft intermediate supports 50, 36 that provide support and prevent sagging.

Figure 2:
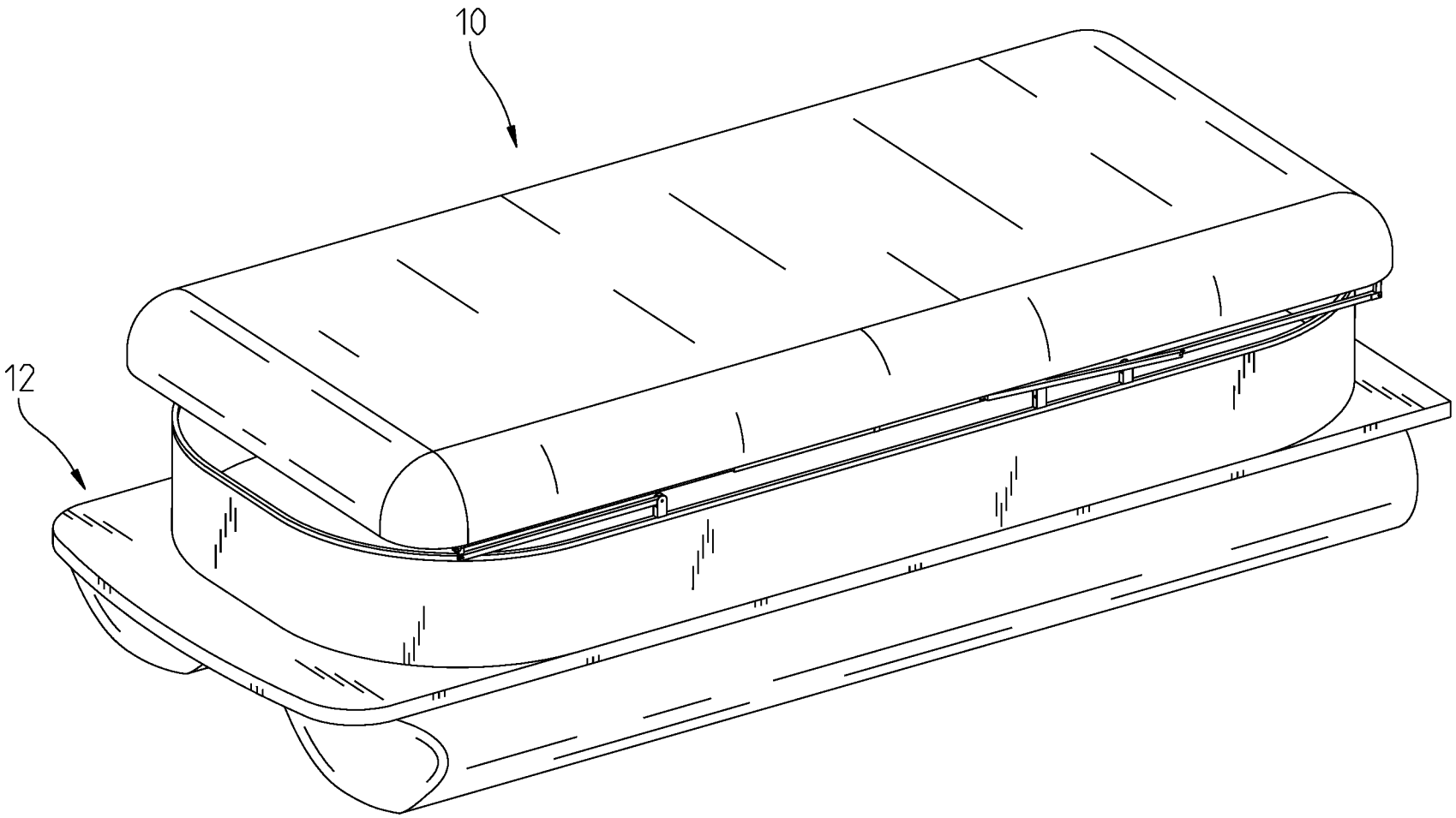
FIG. 2 is a side isometric view of the retractable cover in FIG. 1 in the covered position.

The frame mechanism 20 has a base 30 that provides secure pivot and attachment points for a front frame section 32, link members 46, 48, and a rear frame section 34. The base 30 is attached to the perimeter of the watercraft 12, as shown in FIGS. 1 and 2. As shown, the base 30 is a structural component where moving frame components are attached, but it is contemplated that the base 30 is part of or integral to the watercraft 12.

The rear frame section 34 is an assembly that can pivot about rear pivots 35, 37 between a raised position (shown in FIG. 5) and a lowered position (shown in FIG. 6) and has a rear bow 38. The rear frame section 34 can move between the raised and lowered positions manually or through actuators such as electric motors. It is further contemplated that other assistance devices are implemented such as spring-loaded hinges, counterbalance springs or weights, or gas charged struts. In the lowered position, shown in FIGS. 3 and 6, the rear frame section 34 is close to or contacting the base 30. In the raised position, shown in FIGS. 1, 4-5, and 8-9, the rear frame section 34 is angled upwardly and away from the base 30. The rear bow 38 is pivotable about pivots 104, 106 between positions where it is aligned with the rear frame section 34 (shown in FIG. 8) or perpendicular to it (shown in FIG. 10). The rear frame section 34 also includes an aft intermediate support 36 that can move between a deployed position (shown in FIG. 6) and a collapsed position (shown in FIG. 5). The aft intermediate support 36 is made up of an aft intermediate bow 90 that is connected to the rear frame section 34 through rear links 92, 94 that pivot about pivot points 100, 102. The aft intermediate bow 90 can pivot with respect to the rear links 92, 94 at pivot points 96, 98. The aft intermediate bow 90 is connected to the rear bow 38 through a rear telescoping scissor linkage 110. The scissor linkage 110 is a combination of four telescoping members 120, 122, 124, 126 that are connected at a central pivot 112 at one end. Members 122 and 126 are affixed to each other, as well as members 120 and 124, so they can only extend with respect to each other. The pairs of members pivot at the central pivot 112 as the linkage 110 expands and collapses. The terminal end of each telescoping member is connected to either the aft intermediate bow 90 or rear bow 38 near where a flat portion of the bow transitions to a curved portion, shown in FIG. 6. The scissor linkage 110 maintains the relationship of the bows 90, 38 and provides additional support for the fabric located between the bows. For example, telescoping members 120 and 124 are affixed together at the central pivot 112 and can only telescope with respect to each other. The same applies to telescoping members 122 and 126. Where each telescoping member is attached to its respective bow, there is a pivot point that allows the telescoping member to rotate with respect to the bow.

Figure 9:
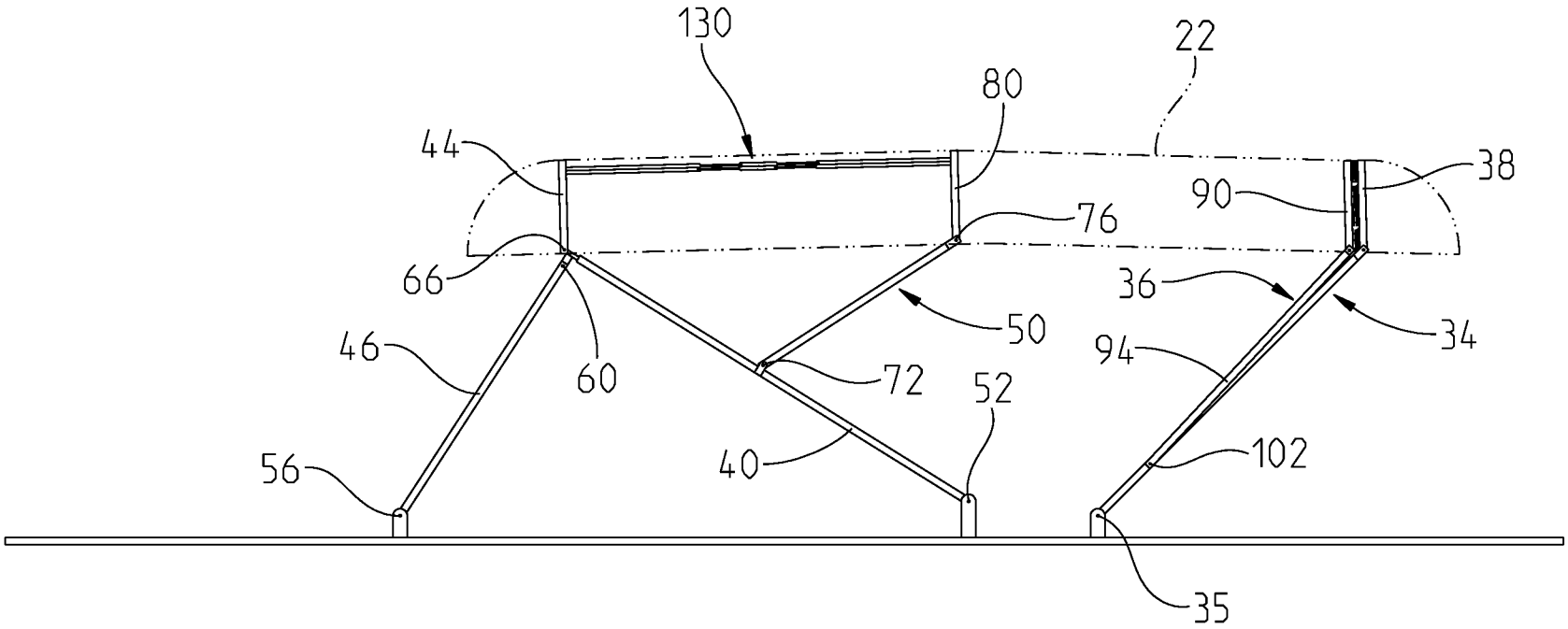
FIG. 9 is a side view of the cover in the Bimini position.
Figure 10:
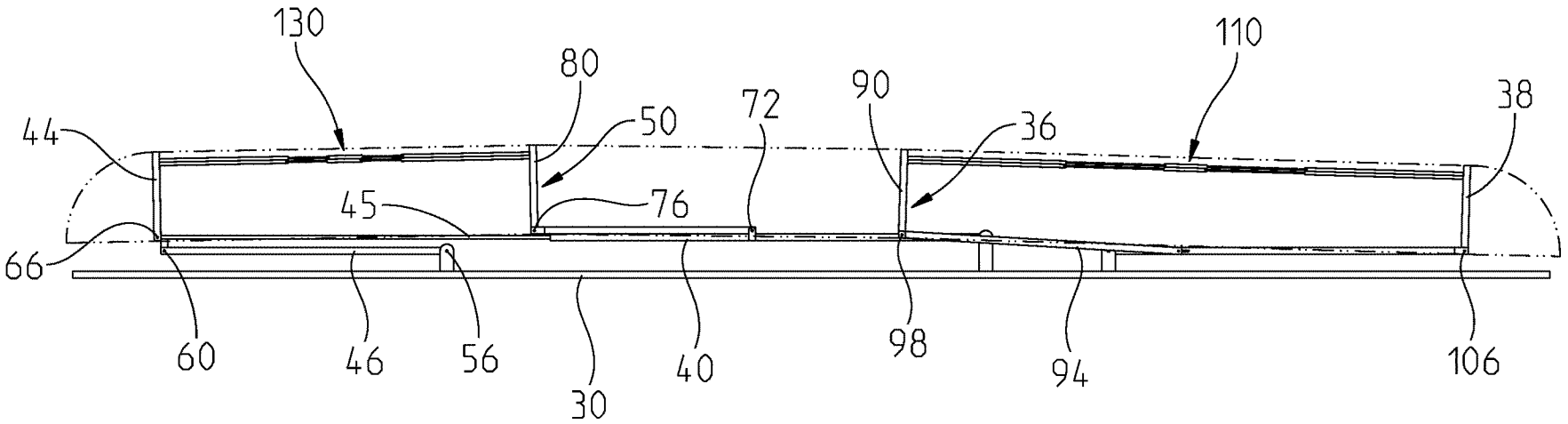
FIG. 10 is a side view of the cover in the covered position.
Figure 11:
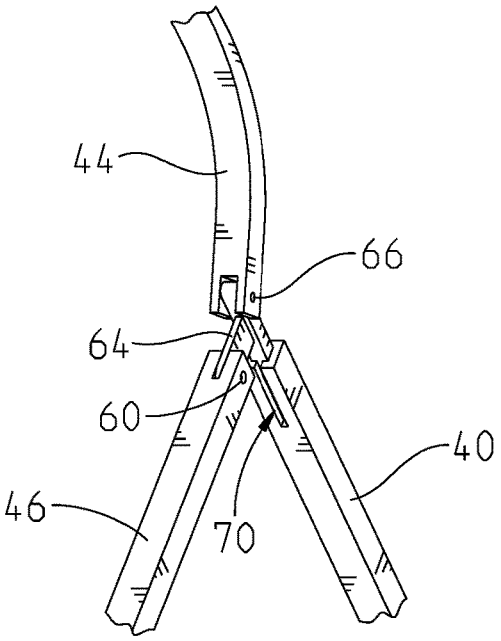
FIG. 11 is a partial bottom isometric view of the frame shown in FIG. 5.
Figure 12:
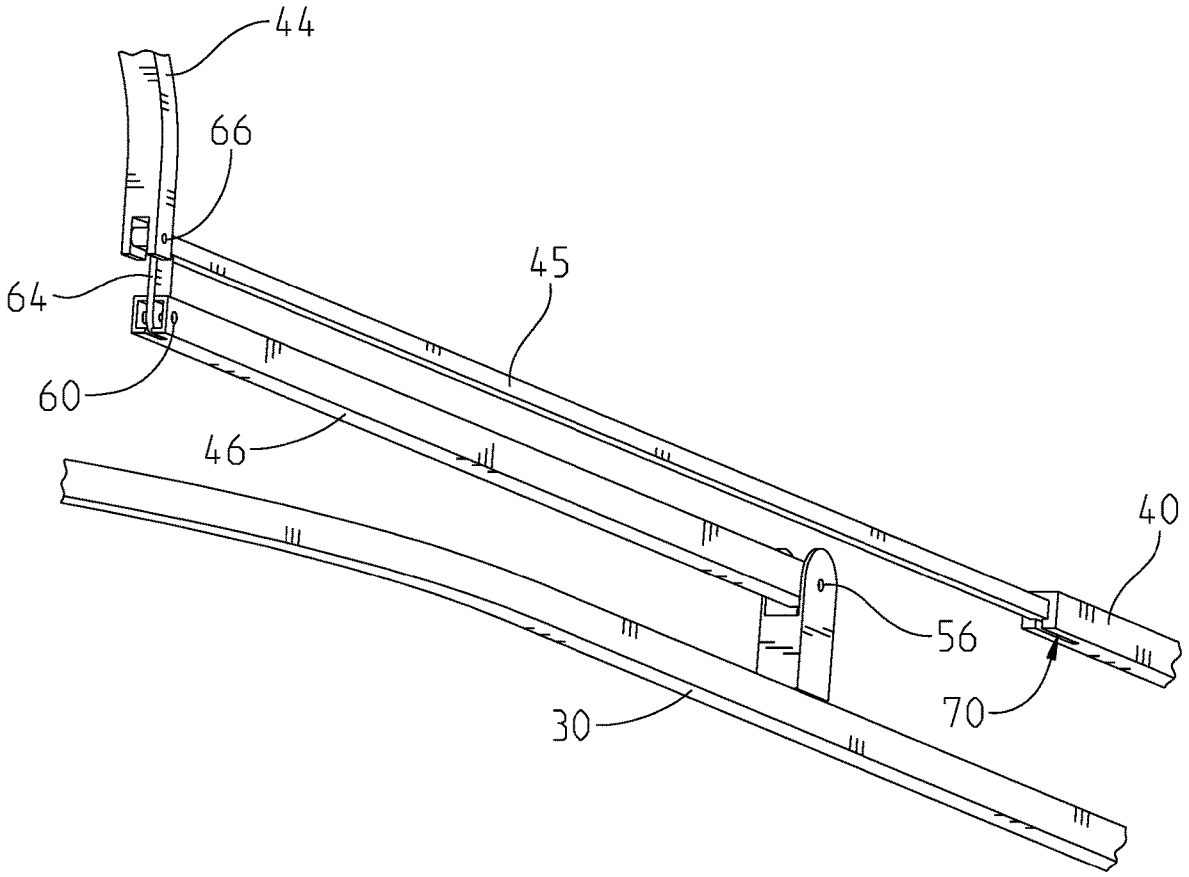
FIG. 12 is a partial bottom isometric view of the frame shown in FIG. 6.

The front frame section 32 is more complex than the rear frame section 34 in that a front bow 44 telescopically extends outwardly when the cover moves to the covered position. The telescoping of the front bow 44 includes selectively connecting a pair of inner telescoping slides 45, 47 that reside in front frame members 40, 42 to link members 46, 48 to form telescoping pivots 60, 62. This is shown in FIGS. 5 and 9. As will be described in greater detail below, the front frame members 40, 42, link members 46, 48 and front bow 44 cooperate to extend outwardly as shown in FIGS. 6, 10, and 12. The front bow 44 can pivot about pivots 66, 68. The front frame members 40, 42 are connected to the base 30 at front pivots 52, 54. The link members 46, 48 attach to the base 30 at link pivots 56, 58. Opposite the link pivots 56, 58, the link members 46, 48 attach to telescoping pivots 60, 62 on the inner telescoping slides 45, 47. As shown in FIGS. 11-12, the telescoping pivots 60, 62 are located on a tang 64 that is affixed to the inner telescoping slides 45, 47. Also shown in FIGS. 11-12 is a tang slot 70 that may receive the tang 64. The inner telescoping slides 45, 47 are received by the front frame members 40, 42 and can telescope between a retracted position (shown in FIG. 5) and an extended position (shown in FIG. 6). It is contemplated that the link members 46, 48 are not used, and telescoping is accomplished through actuators, rack-and-pinion gears, gas struts, or a spring-loaded mechanism. In the retracted position, the tang slot 70 may receive the tang 64. In the extended position, shown in FIGS. 6 and 11, the tang 64 is clear of the tang slot 70.

The front frame section 32 includes a fore intermediate support 50. The fore intermediate support 50 is best shown in FIGS. 5 and 9 and provides support for the cover fabric 22 when the cover is in the Bimini position and covered position. As shown, the fore intermediate support 50 includes two pivot points, with the first pivot 72, 74 located where the fore intermediate support 50 is attached to the front frame members 40, 42. A second pivot 76, 78 allows a curved front intermediate bow 80 to pivot between a folded position, shown in FIG. 3 and two different use positions, shown in FIGS. 5 and 6. When the cover 10 is in the covered position, the second pivot is at 90 degrees and in the Bimini position, the second pivot is at an obtuse angle. The second pivot 76, 78 allows the front intermediate bow 80 to be secured to the cover fabric 22 and allow the frame mechanism 20 to move between the covered and Bimini positions while still allowing the cover fabric 22 to remain in tension. The front frame section 32 also includes a front telescoping scissor linkage 130, which shares the same structure and operation of the scissor linkage 110. The front telescoping linkage 130 connects between the front intermediate bow 80 and front bow 44.

Figure 3:
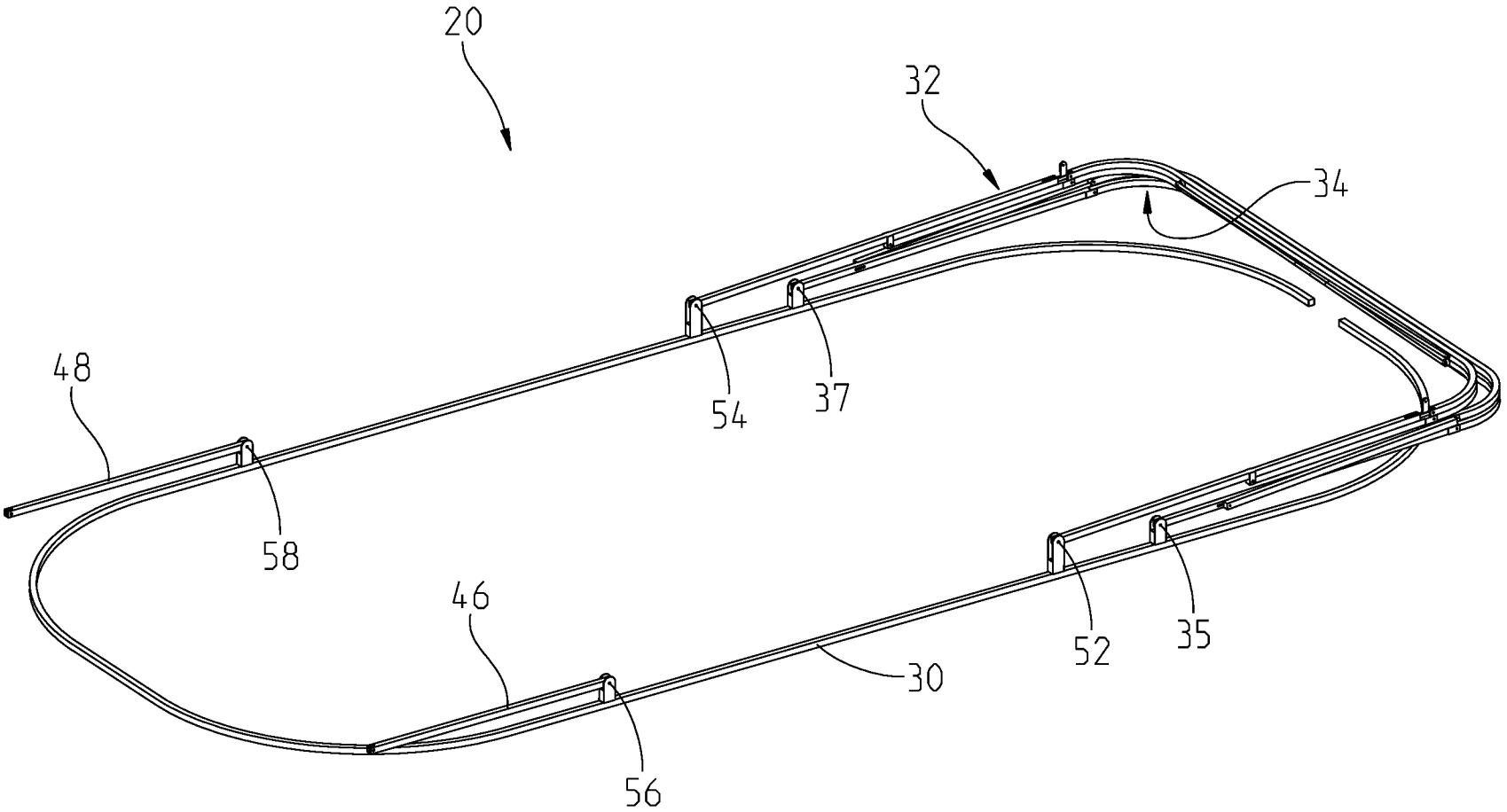
FIG. 3 is a side isometric view of a frame used in the retractable cover in the stowed position.

The front frame section 32 moves between a stowed and a covered position. Other positions include the radar position, shown in FIG. 4 and the Bimini position, shown in FIG. 5. When the front frame section 32 is moved rearward from the Bimini position, the link members 46, 48 are disconnected where they connect to the tang 64. This is shown in FIGS. 3 and 4.

The cover fabric 22 is secured to the telescoping front bow 44, rear bow 38, along with the fore and aft intermediate bows 80, 90 to provide support and prevent sagging of the fabric when the cover 10 is in the covered and Bimini positions. In addition, the connection of the cover fabric 22 to the bows is used to deploy the intermediate supports at certain points. In the stowed and radar positions, the cover fabric 22 is gathered or bunched together.

The operation of the retractable cover 10 is hereinafter described. The front and rear frame sections 32, 34 are moveable between predetermined positions, with the cover fabric 22 assisting deploy the intermediate supports 50, 36 as the frame sections 32, 34 move and the telescoping scissor linkages 110, 130 control the relationship and angles of the bows (44 and 80, 90 and 38). As can be seen in FIGS. 7-10, the bows remain parallel to each other as they separate. In other words, the bows do not rotate with respect to each other as each frame section moves between positions. The rear frame section 34 is moveable between a first (lowered) and second (raised) position. The front frame section 32 is able to move between a first (lowered) position, second (raised) position, third (forward) position (shown in FIG. 9), and a fourth (telescoped) position (shown in FIG. 10). In the first position, the frame section is rearward and overlaying a rear portion of the base 30, shown in FIG. 3. In the second position, the frame section is rotated away from the base 30 and raised up, shown in FIG. 4. For the front frame section 32, the third (forward) position is defined by the front frame section 32 forward of its front pivot 52, 54 where the user can connect the link members 46, 48, shown in FIG. 5. In the fourth (telescoped) position, the front frame section 32 is rotated fully forward, fully telescoped, and overlays a front portion of the base 30, shown in FIG. 6.

The cover 10 can move between any of the positions. By way of example only, the cover 10 starts in the stowed position, shown in FIGS. 3 and 7. In the stowed position, the front and rear frame sections 32, 34 are in the first position defined by the frame sections either in contact or close proximity to each other, and both are overlaying the rearmost portion of the base 30. In this position, the frame sections 32, 34 are either parallel to the base 30 or substantially parallel. Substantially parallel is defined as the frame section being less than 10 degrees from the base 30. Further, the intermediate supports 50, 36 are fully collapsed, along with the telescoping scissor linkages 110, 130. The cover fabric 22 is bunched up between the bows 44, 80, 90, 38 and the link members 46, 48 are disconnected. The user may then move the cover 10 to the radar, Bimini, or covered position. To move the cover to the radar position, the front and rear frame sections 32, 34 are moved to their second position, shown in FIG. 8. The cover fabric 22 remains bunched up between the bows in the radar position. The radar position may only be implemented to fuel or service the watercraft 12 or provide access for users to enter or exit the rear.

Moving the cover to the Bimini position means the front frame section 32 is moved to the third position and the rear frame section 34 is either moved to or already in the second position. As the front frame section 32 begins to separate from the rear frame section 34, the cover fabric 22 begins to stretch out. As the front frame section 32 pivots forward, the front telescoping scissor linkage 130 expands to allow the fore intermediate support 50 to deploy as shown in FIG. 9. The front telescoping scissor linkage 130 maintains the parallel relationship of the front bow 44 and fore intermediate bow 80. The cover fabric 22 located between the fore and aft intermediate supports 50, 36 also stretches out. When front frame section 32 reaches the third position, the fabric between the front bow 44, fore intermediate support 50 and aft intermediate support 36 is pulled tight. At this same time, the link members 46, 48 can be attached to the tangs 64. It is contemplated that the link members 46, 48 are not attached at this point, and the frame mechanism 20 is supported by motors, counterbalance, or other device that holds the front frame section 32 in the third position.

To move the cover 10 to the covered position, the rear frame section 34 is moved to the first position and the front frame section 32 is moved to the fourth position where both front and rear sections are facing in opposite directions and substantially parallel to the base 30. Before the front frame section 32 can be moved from the third position towards the fourth position, the link members 46, 48 must be attached to the tangs 64. The link members 46, 48 rotate towards the front portion of the base 30, which causes the telescoping slides 45, 47 to extend out from the front frame members 40, 42. The telescoping action of the telescoping slides 45, 47 allows the front frame section 32 to extend the front bow 44 to the front of the watercraft 12. Movement of the rear frame section 34 to the first position and the front frame section 32 to the fourth position causes the portion of the cover fabric 22 between the aft intermediate bow 90 and rear bow 38 to stretch out. The separation of the aft intermediate bow 90 and rear bow 38 causes the rear telescoping scissor linkage 110 to expand. The rear telescoping scissor linkage 110 maintains the parallel relationship of the rear bow 38 and aft intermediate bow 90. In the covered position, the cover fabric 22 extends from the bow to the stern of the watercraft 12, completely covering the deck area. The intermediate bows 80, 90 and scissor linkages 110, 130 provide shape to the fabric and prevent sagging of the material between the front bow 44 and rear bow 38.

When moved between any of the positions described herein, a tensioning device may be used to move the rear frame section 34, front frame section 32, and/or maintain the tensioning of the cover fabric 22 while the front and rear frame sections 32, 34 move closer to each other. Electric motors may be used at the rear pivots 35, 37, front pivots 52, 54 and/or link pivots 56, 58. In addition, powered winches or cables can be attached to the frame sections 32, 34 to move them to positions described herein.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A convertible cover for a watercraft having a deck, said convertible cover comprising:

a base for attachment to said watercraft;

a front frame section pivotable with respect to said base about a front pivot, said front frame section having a fore intermediate support coupled thereto, said fore intermediate support having a fore intermediate bow coupled thereto, a front support telescopically extendable from said front frame section, said front support having a front bow rotatably coupled thereto, said front bow connected to said fore intermediate bow by a front telescoping scissor linkage;

link members pivotable with respect to said base, said link members couplable to said front support only when said front frame section is forward of said front pivot, when said link members are coupled to said front support, said link members cooperating with said front support to telescopically extend said front support when said front frame section is pivoted to a position substantially parallel to said base and forward of said front pivot;

a rear frame section independently moveable with respect to said front frame section and pivotable with respect to said base about a rear pivot, said front pivot spaced forward of said rear pivot, said rear frame section having an aft intermediate support coupled thereto, a rear bow rotatably coupled to said rear frame section, said aft intermediate support having an aft intermediate bow coupled thereto, said rear bow connected to said aft intermediate bow by a rear telescoping scissor linkage; and cover fabric attached to and extending between said front, rear, and intermediate bows, said cover fabric covering said deck when said front support is telescopically extended and said rear frame section is rearward of said rear pivot and substantially parallel to said base.

2. The convertible cover in claim 1, wherein said bows of said front frame section and said bows of said rear frame section do not rotate with respect to each other.

3. The convertible cover in claim 1, wherein each said telescoping scissor linkage comprises a pair of telescoping members affixed at a central pivot.

4. The convertible cover in claim 1, wherein said rear frame section is only coupled to said front frame section through said cover fabric.

5. The convertible cover in claim 1, further comprising a motor to rotatably position said link members.

6. The convertible cover in claim 1, further comprising a motor to rotatably position at least one of said frame sections.

7. A convertible cover for a watercraft having a deck, said convertible cover comprising:

a flexible cover;

a frame mechanism positionable between a covered position defined by said flexible cover extending across and covering said deck, a Bimini position defined by said cover overlaying a portion of said deck, and a stored position defined by said cover clear of said deck;

said frame mechanism having a base for attachment to said watercraft, a front frame section, and a rear frame section;

said front frame section pivotable about a front pivot with respect to said base, said front frame section having a fore intermediate support coupled thereto, a front support telescopically extendable with respect to said front frame section in said covered position, said fore intermediate support having a fore intermediate bow coupled thereto, said front support having a front bow coupled thereto, said front bow attached to said fore intermediate bow by a front telescoping scissor linkage;

link members pivotable with respect to said base at link pivots located forward of said front pivots, said link members couplable to said front support when said front frame section is in said Bimini position;

a rear frame section pivotable about a rear pivot with respect to said base, said rear frame section having an aft intermediate support coupled thereto, a rear bow coupled to said rear frame section; said aft intermediate support having an aft intermediate bow coupled thereto, said rear bow attached to said aft intermediate bow by a rear telescoping scissor linkage; and cover fabric attached to said front and rear bows, said cover covering said watercraft when said front frame is in said lowered position and said rear frame section is in said lowered position.

8. The convertible cover in claim 7, wherein said bows of said front frame section and said bows of said rear frame section do not rotate with respect to each other.

9. The convertible cover in claim 7, wherein each said telescoping scissor linkage comprises a pair of telescoping members affixed at a central pivot.

10. The convertible cover in claim 7, wherein said rear frame section is only coupled to said front frame section through said cover fabric.

11. The convertible cover in claim 7, further comprising a motor to rotatably position said link members.

12. The convertible cover in claim 7, further comprising a motor to rotatably position at least one of said frame sections.

13. A convertible cover for a watercraft having a deck, said convertible cover comprising:

a base for attachment to said watercraft;

a front frame section pivotable with respect to said base about a front pivot, a front support telescopically extendable from said front frame section, said front support having a front bow;

link members pivotable with respect to said base, said link members couplable to said front support when said front frame section is forward of said front pivot, when said link members are coupled to said front support, said link members cooperating with said front support to telescopically extend said front support when said front frame section is pivoted to a position substantially parallel to said base and forward of said front pivot;

a rear frame section independently moveable with respect to said front frame section and pivotable with respect to said base about a rear pivot, said front pivot spaced forward of said rear pivot, a rear bow attached to said rear frame section; and cover fabric attached to and extending between said front and rear bows, said cover fabric covering said deck when said front support is telescopically extended and said rear frame section is rearward of said rear pivot and substantially parallel to said base.

14. The convertible cover in claim 13, further comprising a fore intermediate support coupled to said front frame section, said fore intermediate support having a fore intermediate bow coupled thereto, a front telescoping scissor linkage connecting said front bow to said fore intermediate bow.

15. The convertible cover in claim 14, wherein said telescoping scissor linkage comprises a pair of telescoping members affixed at a central pivot.

16. The convertible cover in claim 13, further comprising an aft intermediate support coupled to said rear frame section, said aft intermediate support having an aft intermediate bow coupled thereto, a rear telescoping scissor linkage connecting said rear bow to said aft intermediate bow.

17. The convertible cover in claim 16, wherein said bows of said front frame section and said bows of said rear frame section do not rotate with respect to each other.

18. The convertible cover in claim 13, wherein said rear frame section is only coupled to said front frame section through said cover fabric.

19. The convertible cover in claim 13, further comprising a motor to rotatably position said link members.

20. The convertible cover in claim 13, further comprising a motor to rotatably position at least one of said frame sections.

* * * * *